US006228805B1

(12) United States Patent
Ohshima et al.

(10) Patent No.: US 6,228,805 B1
(45) Date of Patent: May 8, 2001

(54) THERMAL TRANSFER PRINTING SHEET AND PROCESS OF DOUBLE-SIDE TRANSFER PRINTING

(75) Inventors: Katsuyuki Ohshima; Jiro Onishi; Mikiko Kudo, all of Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/346,542

(22) Filed: Jul. 2, 1999

Related U.S. Application Data

(63) Continuation-in-part of application No. 08/788,031, filed on Jan. 23, 1997, now abandoned.

(30) Foreign Application Priority Data

Jan. 29, 1996 (JP) ..... 8-34409

(51) Int. Cl.[7] ..... B41M 5/20

(52) U.S. Cl. ..... 503/227; 427/152; 428/195; 428/484; 428/913; 428/914

(58) Field of Search ..... 8/471; 427/152; 428/195, 484, 488.1, 488.4, 913, 914; 503/227

(56) References Cited

U.S. PATENT DOCUMENTS

| | | | |
|---|---|---|---|
| 4,815,872 | 3/1989 | Nagashima | 400/120 |
| 5,277,501 | 1/1994 | Tanaka et al. | 400/120 |
| 5,284,816 | 2/1994 | Stephenson | 503/227 |
| 5,538,831 | 7/1996 | Oshima | 430/201 |

FOREIGN PATENT DOCUMENTS

| | | |
|---|---|---|
| 0 389 635 A1 | 10/1990 | (EP) . |
| 0 481 091 A1 | 4/1992 | (EP) . |
| 2 521 488 | 8/1983 | (FR) . |

*Primary Examiner*—Bruce H. Hess
(74) *Attorney, Agent, or Firm*—Parkhurst & Wendel, LLP

(57) ABSTRACT

Disclosed herein are a thermal transfer printing sheet capable of efficiently transferring images, letters, symbols or the like to both surfaces of an image-receiving material, and a process of double-side transfer printing using the same. The thermal transfer printing sheet comprises a substrate sheet; an area for surface transfer printing, comprising at least a sublimable dye layer composed of sections of one or more colors; and an area for reverse transfer printing, comprising at least a hot-melt ink layer composed of sections of ohe or more colors, the two areas being alternately provided on one surface of the substrate sheet. An image is printed on the surface of an image-receiving material by using the area for surface transfer printing, and another image is printed on the back of the image-receiving material by using the area for reverse transfer printing. Double-side transfer printing can thus be efficiently conducted without leaving unused areas on the thermal transfer printing sheet.

10 Claims, 5 Drawing Sheets

THERMAL TRANSFER PRINTING SHEET AND PROCESS OF DOUBLE-SIDE TRANSFER PRINTING

This is a Continuation-in-Part of application Ser. No. 08/788,031 filed Jan. 23 1997, now abandoned.

BACKGROUND OF THE INVENTION

1. Field of the Invention

The present invention relates to a thermal transfer printing sheet useful for transferring images, letters, symbols or the like on both surfaces of an image-receiving material by a thermal transfer printing process, and to a process of double-side transfer printing using the same.

2. Related Art

Heretofore, a thermal transfer printing process has been used to form images with gradation, or monotone letters, symbols or the like on an image-receiving material. The heat-sensitive sublimation transfer printing process or the hot-melt transfer printing process is extensively employed as the thermal transfer printing process.

The heat-sensitive sublimation transfer printing process is as follows: a thermal transfer printing sheet comprising a substrate sheet, and a sublimable dye layer provided thereon, containing a binder resin, and, as a coloring material, a sublimable dye which is dissolved or dispersed in the binder resin is superposed on an image-receiving material, and energy is applied to the thermal transfer printing sheet by a heating device such as a thermal head according to image information so as to transfer the dye contained in the sublimable dye layer of the thermal transfer printing sheet to the image-receiving material, thereby producing an image on the image-receiving material.

The hot-melt transfer printing process is as follows: a thermal transfer printing sheet comprising a substrate sheet, and a hot-melt ink layer provided thereon, containing a coloring agent such as a pigment, and a vehicle such as a wax is superposed on an image-receiving material, and energy is applied to the thermal transfer printing sheet by a heating device such as a thermal head according to image information so as to transfer the softened hot-melt ink layer to the image-receiving material, thereby producing an image on the image-receiving S material.

The above-described heat-sensitive sublimation transfer printing process is advantageous in that it can produce an image excellent in gradation because the amount of the dye to be transferred to the image-receiving material can be controlled in each dot by changing the amount of energy applied to the thermal transfer printing sheet. However, monotone images such as letters or symbols produced by this process are poor in sharpness, so that this printing process is not suitable for the recording of is OCR letters, bar codes or the like which will be optically read. The hot-melt transfer printing process is advantageous in that it can readily produce monotone images such as letters or symbols. However, it is difficult to produce, by this printing process, an image with gradation such as a photograph of a person's face.

In order to solve the aforementioned problems in the thermal transfer printing processes, a complex-type thermal transfer printing sheet comprising a sublimable dye layer and a hot-melt ink layer which are alternately provided on one surface of a continuous substrate sheet is used for conducting transfer printing. The thermal transfer printing sheet 71 shown in FIG. 12 is one example of such a thermal transfer printing sheet. This thermal transfer printing sheet comprises a sublimable dye layer 72 composed of sections (72Y, 72M, 72C) of three colors of yellow (Y), magenta (M) and cyan (C), and a hot-melt ink layer composed of a black ink layer 73 (BK) and a protective layer 74 (OP). In this thermal transfer printing sheet, the sublimable dye layer and the hot-melt ink layer are sequentially provided on one surface of the substrate sheet in the order of Y-M-C-BK-OP, and this unit Y-M-C-BK-OP is provided repeatedly.

The above thermal transfer printing sheet is used, for example, in the following manner: after an image with gradation is formed by using the sublimable dye layer 72 (72Y, 72M, 72C), and letters etc. are formed by using the black ink layer 73 (BK) on the surface of an image-receiving material, the protective layer 74 (OP) is transferred to the entire surface of the image and letters etc. formed (the first repeating unit Y-M-C-BK-OP is used for these steps); the image-receiving material is then turned over, and letters etc. are formed by using the black ink layer 73 (BK) on the back of the image-receiving material (the second repeating unit Y-M-C-BK-OP is used for this step). Therefore, among the second repeating unit Y-M-C-BK-OP, only the black ink layer 73 (BK) is used, and the sublimable dye layer 72 (72Y, 72M, 72C) and the protective layer 74 (OP) are not used at all. The second repeating unit in which only the black ink layer 73 (BK) is used cannot be used to form an image on a new image-receiving material any more, so that the third and fourth repeating units have to be used for this purpose. This means that the sublimable dye layer (72Y, 72M, 72C) and the protective layer 74 (OP) are left unused in every other repeating unit Y-M-C-BK-OP provided on this thermal transfer printing sheet. This thermal transfer printing sheet is thus poor in the efficiency of double-side transfer printing, and it is difficult to decrease the running cost.

The present invention has been accomplished in the light of the aforementioned circumstances. An object of the present invention is therefore to provide a thermal transfer printing sheet useful for efficiently transferring images, letters, symbols or the like on both surfaces of an image-receiving material by a thermal transfer printing process, and a process of double-side transfer printing using the same.

SUMMARY OF THE INVENTION

The above object of the invention can be attained by a thermal transfer printing sheet for thermally transferring images on both surfaces of an image-receiving material, comprising a substrate sheet; an area for surface transfer printing, comprising at least a sublimable dye layer composed of sections of one or more colors; and an area for reverse transfer printing, comprising at least a hot-melt ink layer composed of sections of one or more colors, the two areas being alternately provided on one surface of the substrate sheet.

Further, in the thermal transfer printing sheet of the present invention, the area for surface transfer printing comprises the above-described sublimable dye layer and a transferable protective laminate, and the area for reverse transfer printing comprises the above-described hot-melt ink layer and a transferable protective laminate.

Furthermore, in the thermal transfer printing sheet of the present invention, the area for surface transfer printing comprises the above-described sublimable dye layer, a hot-melt ink layer and a transferable protective laminate, and the area for reverse transfer printing comprises the above-described hot-melt ink layer and a transferable protective laminate.

Furthermore, in the thermal transfer printing sheet of the present invention, the above-described sublimable dye layer is composed of sections of three colors of yellow, magenta and cyan, the above-described hot-melt ink layer is a hot-melt ink layer of black color, and the above-described transferable protective laminate is provided by laminating a protective layer and an adhesive layer on the substrate sheet in this order, the protective layer comprising as a main component a mixture of an acrylic resin, a wax, a vinyl chloride-vinyl acetate copolymer and a polyester resin, or comprising as a main component an ionizing-radiation-hardened resin, or comprising as a main component a mixture of polymethyl methacrylate and a wax, or comprising as main components a resin soluble in water and particles insoluble in a solvent.

Furthermore, in the thermal transfer printing sheet of the present invention, the above-described transferable protective laminate is provided by laminating a protective layer, an ultraviolet-absorbing layer and an adhesive layer on the -substrate sheet in this order, the ultraviolet-absorbing layer comprising an ultraviolet-absorbing polymer; or the transferable protective laminate is provided by laminating a protective layer and an adhesive layer on the substrate sheet in this order, the adhesive layer comprising as a main component a vinyl chloride-vinyl acetate copolymer resin and/or an ultraviolet-absorbing polymer.

A process of double-side transfer printing according to the present invention comprises superposing the above-described thermal transfer printing sheet on the surface of an image-receiving material, conducting transfer printing by using the area for surface transfer printing of the thermal transfer printing sheet, superposing the thermal transfer printing sheet on the back of the image-receiving material, and conducting transfer printing by using the area for reverse transfer printing of the thermal transfer printing sheet.

Further, a process of double-side transfer printing according to the present invention comprises superposing the above-described thermal transfer printing sheet on the back of an image-receiving material, conducting transfer printing by using the area for reverse transfer printing of the thermal transfer printing sheet, superposing the thermal transfer printing sheet on the surface of the image-receiving material, and conducting transfer printing by using the area for surface transfer printing of the thermal transfer printing sheet.

Furthermore, a process of double-side transfer printing according to the present invention comprises superposing, on the surface of an image-receiving material, a first thermal transfer printing sheet comprising a substrate sheet, a sublimable dye layer composed of sections of one or more colors, and a hot-melt ink layer composed of sections of one or more colors, the sublimable dye layer and the hot-melt ink layer being alternately provided on one surface of the substrate sheet, the area of the section of each color of the hot-melt ink layer being twice as large as that of the section of each color of the sublimable dye layer; conducting transfer printing by using the whole area of each section of the sublimable dye layer and a half of the area of each section of the hot-melt ink layer; superposing, on the surface of the image-receiving material, a second thermal transfer printing sheet comprising a substrate sheet, and a transferable protective laminate provided on the surface thereof; transferring the transferable protective laminate to the surface of the image-receiving material; superposing the first thermal transfer printing sheet on the back of the image-receiving material; and conducting transfer printing by using the remaining half of each section of the hot-melt ink layer of the first transfer printing sheet.

Furthermore, a process of double-side transfer printing according to the present invention comprises superposing, on the surface of an image-receiving material, a first thermal transfer printing sheet comprising a substrate sheet, a sublimable dye layer composed of sections of one or more colors, a hot-melt ink layer composed of sections of one or more colors, and a transferable protective laminate, the sublimable dye layer, the hot-melt ink layer and the transferable protective laminate being sequentially provided on one surface of the substrate sheet; conducting transfer printing by using the sublimable dye layer, the hot-melt ink layer and the transferable protective laminate; superposing, on the back of the image-receiving material, a second thermal transfer printing sheet comprising a substrate sheet, and a hot-melt ink layer composed of sections of one or more colors, provided on the substrate sheet; and conducting transfer printing by using the hot-melt ink layer of the second thermal transfer printing sheet.

BRIEF DESCRIPTION OF THE DRAWINGS

In the drawings,

FIG. 11 is a perspective view of a unit for reversing an image-receiving material, used in the apparatus shown in FIG. 10; and.

DETAILED DESCRIPTION OF THE INVENTION

By referring to the accompanying drawings, the present invention will now be described in detail.

<Thermal Transfer Printing Sheet of the Invention>

Figure 1:
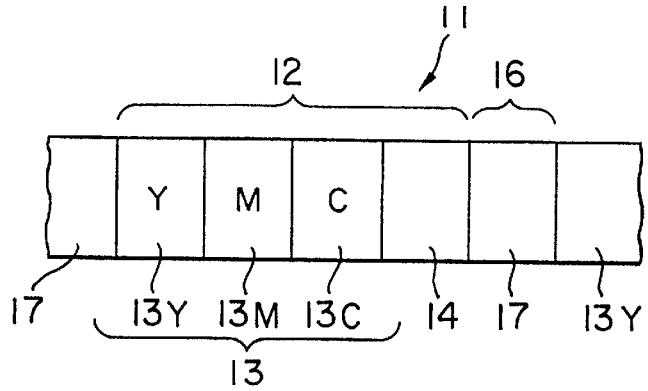
FIG. 1 is a plan view showing one example of the thermal transfer printing sheet of the present invention.

FIG. 1 is a plan view showing one example of the thermal transfer printing sheet of the present invention. As shown in this figure, the thermal transfer printing sheet 11 has an area 12 for surface transfer printing and an area 16 for reverse transfer printing, which are alternately provided on one surface of a substrate sheet.

The area 12 for surface transfer printing consists of a sublimable dye layer 13 composed of sections (13Y, 13M, 13C) of three colors of yellow, magenta and cyan, and a transferable protective laminate 14. The area 16 for reverse transfer printing consists of a hot-melt ink layer 17.

Figure 2:
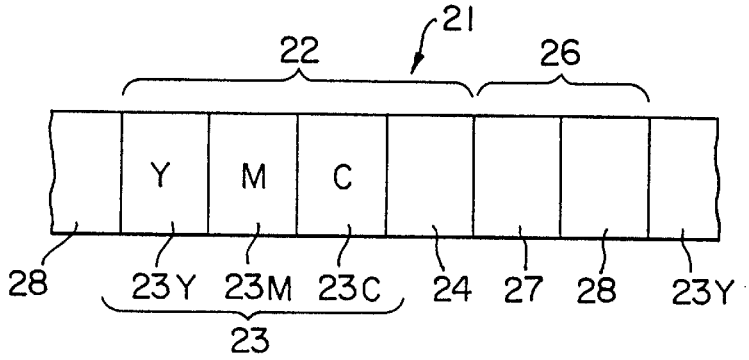
FIG. 2 is a plan view showing another example of the thermal transfer printing sheet of the present invention.

FIG. 2 is a plan view showing another example of the thermal transfer printing sheet of the present invention. As shown in this figure, the thermal transfer printing sheet 21 has an area 22 for surface transfer printing and an area 26 for reverse transfer printing, which are alternately provided on one surface of a substrate sheet.

The area 22 for surface transfer printing consists of a sublimable dye layer 23 composed of sections (23Y, 23M, 23C) of three colors of yellow, magenta and cyan, and a transferable protective laminate 24. The area 26 for reverse transfer printing consists of a hot-melt ink layer 27 and a transferable protective laminate 28.

This thermal transfer printing sheet 21 is different from the thermal transfer printing sheet 11 in that it has the transferable protective laminate 28 also on the area 26 for reverse transfer printing.

Figure 3:
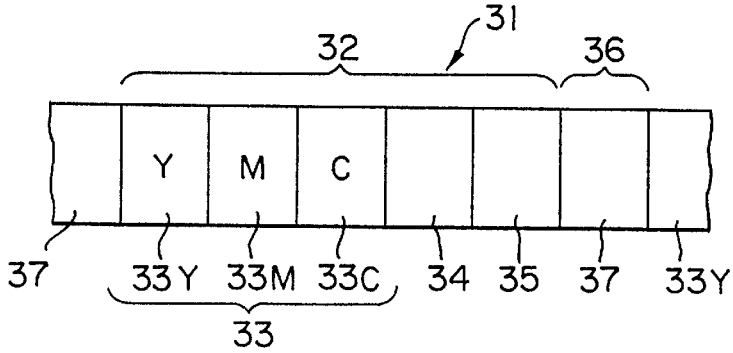
FIG. 3 is a plan view showing still another example of the thermal transfer printing sheet of the present invention.

FIG. 3 is a plan view showing still another example of the thermal transfer printing sheet of the present invention. As shown in this figure, the thermal transfer printing sheet 31 has an area 32 for surface transfer printing and an area 36 for reverse transfer printing, which are alternately provided on one surface of a substrate sheet.

The area 32 for surface transfer printing consists of a sublimable dye layer 33 composed of sections (33Y, 33M, 33C) of three colors of yellow, magenta and cyan, a hot-melt ink layer 34 and a transferable protective laminate 35. The area 36 for reverse transfer printing consists of a hot-melt ink layer 37.

Figure 4:
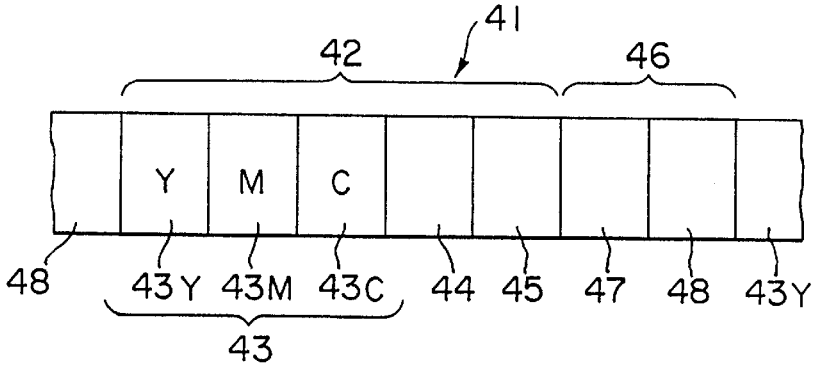
FIG. 4 is a plan view showing yet another example of the thermal transfer printing sheet of the present invention.

FIG. 4 is a plan view showing yet another example of the thermal transfer printing sheet of the present invention. As shown in this figure, the thermal transfer printing sheet 41 has an area 42 for surface transfer printing and an area 46 for reverse transfer printing, which are alternately provided on one surface of a substrate sheet.

The area 42 for surface transfer printing consists of a sublimable dye layer 43 composed of sections (43Y, 43M, 43C) of three colors of yellow, magenta and cyan, a hot-melt ink layer 44 and a transferable protective laminate 45. The area 46 for reverse transfer printing consists of a hot-melt ink layer 47, and a transferable protective laminate 48.

This thermal transfer printing sheet 41 is different from the thermal transfer printing sheet 31 in that it has the transferable protective laminate 48 also on the area 46 for reverse transfer printing.

The structure of each one of the above-described thermal transfer printing sheets of the present invention will now be explained.

Figure 5:
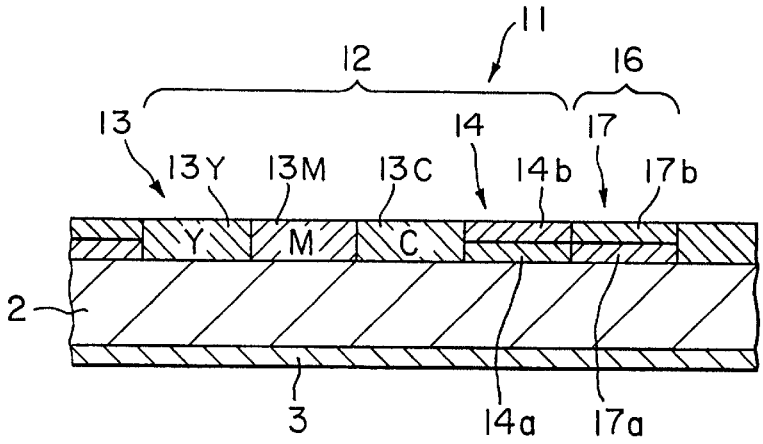
FIG. 5 is a diagrammatic cross-sectional view showing the structure of the thermal transfer printing sheet shown in FIG. 1.

FIG. 5 is a diagrammatical sectional view showing the structure of the thermal transfer printing sheet 11 shown in FIG. 1. As shown in this figure, the thermal transfer printing sheet 11 has an area 12 for surface transfer printing and an area 16 for reverse transfer printing, which are alternately provided on one surface of a substrate sheet 2. Further, a backing layer 3 is provided on the other surface of the substrate sheet 2.

Any substrate sheet which is used for a conventional thermal transfer printing sheet can be used as the substrate sheet 2 of the thermal transfer printing sheet 11. Preferable examples of the substrate sheet specifically include thin papers such as glassine paper, condenser paper and paraffin paper, films of polyesters having high heat resistance such as polyethylene terephthalate, polyethylene naphthalate, polybutylene terephthalate, polyphenylene sulfide, polyether ketone and polyether sulfone, oriented or non-oriented films of plastics such as polypropylene, polycarbonate, cellulose acetate, polyethylene derivatives, polyvinyl chloride, polyvinylidene chloride, polystyrene, polyamide, polyimide, polymethylpentene and ionomers, and laminates of these materials. The thickness of the substrate sheet 2 can be properly selected depending upon the material used so that the substrate sheet can show suitable strength, heat resistance and the like. In general, a sheet having approximately 1 to 100 micrometers is preferably used as the substrate sheet 2.

The sublimable dye layer 13 (13Y, 13M, 13C) contained in the area 12 for surface transfer printing of the thermal transfer printing sheet 11 comprises a sublimable dye bound by a binder resin.

There is no particular limitation on the sublimable dye, and any sublimable dye which is used for a conventional thermal transfer printing sheet for use in the heat-sensitive sublimation transfer printing process can be used. Specific examples of the sublimable dye include Phorone Brilliant Yellow S-6GL, PTY-52 and Macrolex Yellow S-6G as yellows dyes; MS Red, Macrolex Red Violet R, Ceres Red 7B, Samaron Red HBSL and SK Rubine SEGL as red dyes; and Kayaset Blue 714, Waxoline Blue AP-FW, Phorone Brilliant Blue S-R, MS Blue, 100 and Daito Blue No. 1 as blue dyes.

There is no particular limitation on the binder resin for use in the sublimable dye layer 13, and any binder resin which is used for a conventional thermal transfer printing sheet for use in the heat-sensitive sublimation transfer printing process can be used. Specific examples of the binder resin include cellulose resins such as ethyl cellulose, hydroxyethyl cellulose, hydroxypropyl cellulose, methyl cellulose, cellulose acetate and cellulose acetate butyrate, and vinyl resins such as polyvinyl alcohol, polyvinyl acetate, polyvinyl butyral, polyvinyl acetal, polyvinyl pyrrolidone and polyacrylamide. Of these, polyvinyl acetal and polyvinyl butyral are particularly preferred from the viewpoints of heat resistance and dye transfer upon heating. The sublimable dye layer 13 can contain, in addition to the above-described dye and binder resin, various known additives as needed.

The sublimable dye layer 13 can be formed by coating an ink which is prepared by dissolving or dispersing the above-described dye and binder resin, and other additives in a proper solvent onto the surface of the substrate sheet by a known means such as the gravure coating method, and drying the ink coated. The ink is coated onto the substrate sheet in such an amount that the sublimable dye layer 13 will have a thickness of approximately 0.2 to 5 micrometers, preferably about 0.4 to 2 micrometers, and contain approximately 5 to 90% by weight, preferably about 10 to 70% by weight of the sublimable dye.

The transferable protective laminate 14 contained in the area 12 for surface transfer printing of the thermal transfer printing sheet 11 is provided by laminating a protective layer 14*a* and an adhesive layer 14*b* on the substrate sheet 2 in this order.

The protective layer 14*a*, which is a constituent of the transferable protective laminate 14, comprises as a main component a mixture of an acrylic resin, a wax, a vinyl chloride-vinyl acetate copolymer and a polyester resin.

An acrylic resin is excellent in transparency, and can produce a relatively strong film. Therefore, it can impart hardness, and durability such as scratch resistance and chemical resistance to the protective layer 14*a*. Further, the transferable protective laminate can be clearly cut when it is thermally transferred to an image-receiving material if an acrylic resin is incorporated into the protective layer.

A wax is incorporated into the protective layer 14*a* so as to impart thereto slip properties. Examples of the wax which can be used include microcrystalline wax, carnauba wax, paraffin wax, Fischer-Tropsh wax, a variety of low-molecular weight polyethylenes, Japanese wax, bees wax, spermaceti, insect wax, wool wax, shellac wax, candellia wax, petrolatum, partially-modified waxes, fatty esters, and fatty amides.

It is preferable to use the above-described wax in an amount of 1 to 20 parts by weight for 100 parts by weight of the acrylic resin used. When the wax is used in an amount of less than 1 part by weight for 100 parts by weight of the acrylic resin, the resulting protective layer 14*a* cannot have sufficiently high scratch resistance. On the other hand, when the wax is used in an amount of more than 20 parts by weight, the resulting protective layer 14*a* is insufficient in durability and transparency.

The vinyl chloride-vinyl acetate copolymer which is used, as a component of the protective layer 14*a*, together with the above-described acrylic resin and wax can impart flexibility to the protective layer 14*a*. The polyester resin which is used as a component of the protective layer 14*a* serves to control the releasing properties of the protective layer at the time of thermal transfer. It is preferable to use the vinyl chloride-vinyl acetate copolymer in an amount of approximately 10 to 80 parts by weight for 100 parts by weight of the acrylic resin. It is preferable to use the polyester resin in an amount of approximately 0.1 to 5 parts by weight for 100 parts by weight of the acrylic resin.

Substantially transparent inorganic or organic fine particles can also be incorporated into the protective layer 14*a*. When such fine particles are incorporated into the protective layer, the transferable protective laminate is more clearly cut when it is thermally transferred to an image-receiving material, and the scratch resistance and the like of the protective layer 14*a* are also improved. In addition, the surface gloss of the protective layer 14*a* is reduced, so that the protective layer is to have a matte surface. Examples of the fine particles which can be used include those ones which have relatively high transparency, such as silica, Teflon powder and nylon powder. It is preferable to use the fine particles in an amount of 1 to 30% by weight of the acrylic. resin. When the fine particles are used in an amount of more than 30% by weight of the acrylic resin, the resulting protective layer 14*a* has decreased transparency and durability.

Further, when such additives as an ultraviolet absorber, an antioxidant and a fluorescent brightener are incorporated into the protective layer 14*a*, an image transferred to an image-receiving material, covered with the protective layer 14*a* has improved gloss, light resistance, weather resistance, whiteness and the like.

The adhesive layer 14*b*, which is a constituent of the transferable protective laminate 14, serves to increase the adhesion between the protective layer 14*a* and an image-receiving material. The adhesive layer 14*b* can be formed by coating onto the protective layer 14*a* a solution of a resin which can show high adhesiveness when thermally melted, such as an acrylic resin, a vinyl chloride resin, a vinyl chloride-vinyl acetate copolymer, an acryl-vinyl chloride-vinyl acetate terpolymer, a polyester resin or a polyamide resin, and drying the resin solution coated. In the case where a card-like material whose surface is made from a polyvinyl chloride resin is used as an image-receiving material, a vinyl chloride-vinyl acetate copolymer, an acryl-vinyl chloride-vinyl acetate terpolymer, an acrylic resin or a polyamide resin can be used as a heat-sensitive adhesive which is highly adherent to the polyvinyl chloride resin and which can be clearly cut when it is thermally transferred to the image-receiving material. The thickness of the adhesive layer 14*b* is approximately 0.5 to 10 micrometers. Further, when such additives as an ultraviolet absorber, an antioxidant and a fluorescent brightener are incorporated into the adhesive layer 14*b*, an image transferred to an image-receiving material, covered with the adhesive layer 14*b* has improved gloss, light resistance, weather resistance, whiteness and the like.

The hot-melt ink layer 17 contained in the area 16 for reverse transfer printing of the thermal transfer printing sheet 11 is provided by laminating a releasing OP layer 17*a* and a coloring ink layer 17*b* on the substrate sheet 2 in this order.

The releasing OP layer 17*a*, which is a constituent of the hot-melt ink layer 17, comprises as a main component a mixture of an acrylic resin, a wax, a vinyl chloride-vinyl acetate copolymer and a polyester resin like the above-described protective layer 14*a*.

The releasing OP layer 17*a* can be formed by coating a proper composition onto the substrate sheet 2 by a known means such as the hot-melt, hot lacquer, gravure, gravure-reverse or roll coating method, and drying the composition coated.

The thickness of such a releasing OP layer 17*a* is preferably about 0.1 to 5 micrometers. In order to make the surface of the releasing OP layer 17*a* matte, fine particles which can be incorporated into the above-described protective layer 14*a* may be added to the releasing OP layer 17*a*.

The coloring ink layer 17*b*, which is a constituent of the hot-melt ink layer 17, comprises a coloring agent, a vehicle, and, when necessary, various additives. Among organic or inorganic pigments or dyes, those ones which have good properties as a recording material, for examples, those ones which can give sufficiently high color densities and which do not fade even when exposed to light or heat are preferable as the coloring agent. The coloring agent is preferably carbon black, or a red, blue or yellow pigment with which letters, symbols or the like having high densities can be clearly printed on an image-receiving material.

In order to increase the adhesion to an image-receiving material, and to impart scratch resistance to an image transferred to an image-receiving material, it is preferable to incorporate, as the vehicle, into the coloring ink layer 17*b* one of the following resin binders so that the amount of the coloring agent will be 20 to 80% by weight of the vehicle:

(1) acrylic resin, (2) acrylic resin+chlorinated rubber, (3) acrylic resin+chlorinated rubber-vinyl acetate copolymer, (4) acrylic resin+cellulose resin, and (5) vinyl chloride-vinyl acetate copolymer resin.

Further, a wax or the like can be used instead of, or together with the above-described resin binder. Typical examples of the wax include microcrystalline wax, carnauba wax and paraffin wax. Besides these waxes, there can be mentioned various waxes such as Fischer-Tropsh wax, a variety of low-molecular weight polyethylenes, Japanese wax, bees wax, spermaceti, insect wax, wool wax, shellac wax, candellia wax, petrolatum, partially-modified waxes, fatty esters, and fatty amides.

Such a coloring ink layer 17*b* of hot-melt type can be formed by coating a proper ink onto the surface of the releasing OP layer 17*a* by a known means such as the hot-melt, hot lacquer, gravure, gravure-reverse or roll coating method, and drying the ink coated. The thickness of the coloring ink layer 17*b* is preferably about 0.2 to 10 micrometers.

The backing layer 3 provided on the other surface of the substrate sheet 2 prevents the thermal fusion between a heating device such as a thermal head and the substrate sheet 2, so that the thermal transfer printing sheet is smoothly carried when thermal transfer printing is conducted. Examples of the resin which can be used for forming this backing layer 3 include cellulose resins such as ethyl cellulose, hydroxy cellulose, hydroxypropyl cellulose, methyl cellulose, cellulose acetate, cellulose acetate butyrate and nitrocellulose, vinyl resins such as polyvinyl alcohol, polyvinyl acetate, polyvinyl butyral, polyvinyl acetal and polyvinyl pyrrolidone, acrylic resins such as polymethyl methacrylate, polyethyl acrylate, polyacryl amide and acrylonitrile-styrene copolymers, and natural or synthetic resins such as polyamide resins, polyvinyltoluene resins, coumarone and indene resins, polyester resins, polyurethane resins, and silicone- or fluorine-modified urethanes. These resins can be used either singly or in combination. In order to impart increased heat resistance to the backing layer 3, it is preferable to select a resin having a hydroxy reactive group from the above-enumerated resins, and to use as a crosslinking agent polyisocyanate or the like together with the resin to obtain a crosslinked resin layer.

Further, in order to make the thermal transfer printing sheet smoothly slidable on a thermal head, it is possible to impart heat-resistant slip properties to the backing layer 3 by adding thereto a solid or liquid releasing agent or lubricant. Examples of the releasing agent or lubricant include various waxes such as polyethylene wax and paraffin wax, higher aliphatic alcohols, organopolysiloxane, anionic surface active agents, cationic surface active agents, ampholytic surface active agents, nonionic surface active agents, fluorine-containing surface active agents, organic carboxylic acids and derivatives thereof, fluororesins, silicone resins, and fine particles of an inorganic compound such as talc and silica. The amount of the releasing agent or lubricant which may be incorporated into the backing layer 3 is 5 to 50% by weight, preferably about 10 to 30% by weight.

The thickness of the backing layer 3 is approximately 0.1 to 10 micrometers, preferably about 0.5 to 5 micrometers.

It is noted that an adhesion-promoting layer may be provided on the surface of the substrate sheet 2 in order to improve the close adhesion of the substrate sheet 2 to the sublimable dye layer 13, to the hot-melt ink layer 17 and to the transferable protective laminate 14. Any layer can be used as this adhesion-promoting layer as long as it can increase the adhesion between the substrate sheet 2 and the transferable protective laminate 14. The adhesion-promoting layer can be formed by coating onto the surface of the substrate a solution of a polyurethane resin, polyester resin, acrylic polyol resin or vinyl chloride-vinyl acetate copolymer, or a mixture thereof, and drying the solution coated. Further, a reactive hardening agent such as polyisocyanate can be added when necessary, and a titanate or silane coupling agent can also be used.

Figure 6:
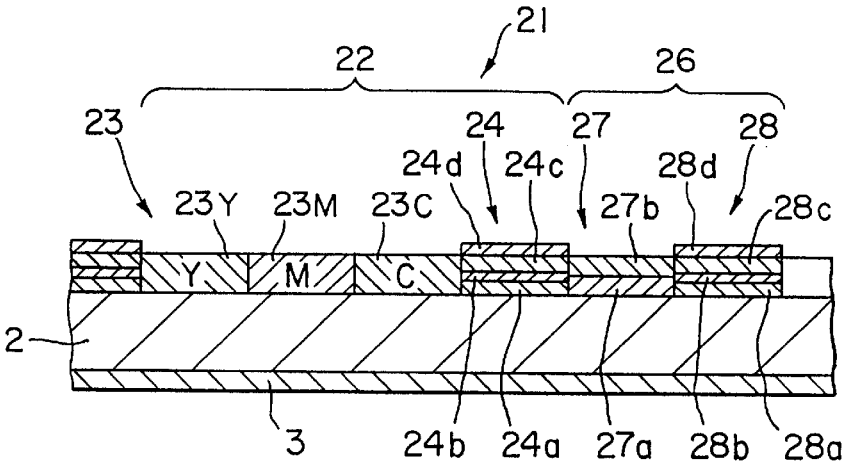
FIG. 6 is a diagrammatic cross-sectional view showing the structure of the thermal transfer printing sheet shown in FIG. 2.

FIG. 6 is a diagrammatical sectional view showing the structure of the thermal transfer printing sheet 21 shown in FIG. 2. As shown in this figure, the thermal transfer printing sheet 21 has an area 22 for surface transfer printing and an area 26 for reverse transfer printing, which are alternately provided on one surface of a substrate sheet 2. Further, a backing layer 3 is provided on the other surface of the substrate sheet 2. The substrate sheet 2 and the backing layer 3 are the same as those of the above-described thermal transfer printing sheet 11. Therefore, explanations for them are omitted here. The area 22 for surface transfer printing of the thermal transfer printing sheet 21 consists of a sublimable dye layer 23 (23Y, 23M, 23C), and a transferable protective laminate 24. The sublimable dye layer 23 can be formed in the same manner as in the formation of the sublimable dye layer 13 of the above-described thermal transfer printing sheet 11, so that an explanation for this layer is omitted here.

The transferable protective laminate 24 contained in the area 22 for surface transfer printing is provided by laminating a protective layer 24*a*, a primer layer 24*b*, an ultraviolet-absorbing layer 24*c* and an adhesive layer 24*d* on the substrate sheet 2 in this order.

The protective layer 24*a*, which is a constituent of the transferable protective laminate 24, comprises as a main component an ionizing-radiation-hardened resin. The thickness of the protective layer 24*a* is preferably about 1 to 10 micrometers.

The ionizing-radiation-hardened resin, which is a component of the protective layer 24*a*, is obtained by crosslinking and hardening a polymer or oligomer containing in the structure thereof radically-polymerizable double bond by the application of ionizing radiation. Alternatively, the ionizing-radiation-hardened resin can be obtained by adding a photo-polymerization initiator to the above polymer or oligomer, and polymerizing and crosslinking the mixture by the application of an electron beam or ultraviolet rays. There is no particular limitation on the ionizing-radiation-hardened resin, and any conventionally-known ionizing-radiation-hardening resin can be used.

Examples of the above radically-polymerizable monomer include acrylate, methacrylate, acrylamide, methacrylamide, allyl compounds, vinyl ethers, vinyl esters, heterocyclic vinyl compounds, N-vinyl compounds, styrene, acrylic acid, methacrylic acid, crotonic acid and itaconic acid. Examples of the multifunctional monomer include diethylene glycol di(meth)acrylate, triethylene glycol di(meth)acrylate, tetraethylene glycol di(meth)acrylate, trimethylol propane tri(meth)acrylate, pentaerythritol tetra(meth)acrylate, dipentaerythritol hexa(meth)acrylate, tris(beta-(meth)acryloyloxyethyl)isocyanurate.

In the case where the hardened resin is obtained by the application of ultraviolet rays, it is possible to add, as a sensitizer, a compound which can dissociate a radical when ultraviolet rays are applied thereto, for example, a benzo ether such as benzoquinone, benzoin or benzoin methyl ether, a halogenated acetophenone, or a diacetyl compound in an amount of approximately 1 to 20% by weight of the above-described radically-polymerizable monomer.

In order to obtain increased flexibility and adhesiveness, a cellulose resin such as ethyl cellulose, a polyester resin, a polyurethane resin, a rosin ester resin, a rubber resin such as cyclized rubber, or an acrylic resin may be added, when necessary, to the above-described ionizing-radiation-hardening resin.

Although these resins are excellent in transparencey, they tend to form relatively strong films. Therefore, there may be a case where the protective layer formed by using one of these resins cannot be clearly cut when it is transferred to an image-receiving material in the process of transfer printing which will be described later. For this reason, it is preferable to add a relatively large amount of fine particles having high transparency to the ionizing-radiation-hardening resin. Examples of such fine particles include inorganic fine particles such as silica, alumina, calcium carbonate, talc and clay, and organic fillers such as acrylic, polyester, melamine, epoxy and polyethylene resins, which have particle diameters of approximately 0.01 to 50 micrometers.

In the case where fine particles of silica or alumina are used as the fine particles, it is possible to use silica or alumina whose particle surfaces have been treated with a silane coupling agent or the like in order to improve the compatibility with the ionizing-radiation-hardening resin. Examples of the silane coupling agent include gamma-methacryl-oxypropyltrimethoxysilane, gamma-methacryloxypropylmethyl-dimethoxysilane, gamma-methacryloxypropyldimethylmethoxysilane, gamma-methacryloxypropyltriethoxysilane, gamma-methacryloxy-propyldimethylethoxysilane, gamma-acryloxypropyltrimethoxy-silane, gamma-acryloxypropyldimethylmethoxysilane, gamma-acryloxypropyltriethoxysilane, gamma-acryloxypropylmethyl-diethoxysilane, gamma-acryloxypropyldimethylethoxysilane and vinylethoxysilane.

The treatment capacity of the silane coupling agent is preferably such that the minimum coating area of the silane coupling agent is from 10 to 100 for 100 of the specific surface area of silica or alumina.

It is preferable that 5 to 50 parts by weight of such fine particles having high transparency be incorporated into 100 parts by weight of the above-described ionizing-radiation-hardening resin. When less than 5 parts by weight of the fine particles are incorporated into 100 parts by weight of the ionizing-radiation-hardening resin, the resulting protective layer 24*a* cannot be clearly cut when it is transferred to an image-receiving material. On the other hand, more than 50 parts by weight of the fine particles are incorporated, the resulting protective layer 24*a* cannot have sufficiently high transparency.

Further, when other additives such as a wax, a lubricant, an ultraviolet absorber, an antioxidant and/or a fluorescent brightener is added to the protective layer 24*a*, an image transferred to an image-receiving material, covered with the protective layer 24*a* has improved slip properties, gloss, light resistance, weather resistance, whiteness and the like.

The following method can be employed as a method for forming the protective layer 24*a* on the substrate sheet 2: an ink is prepared by adding a proper solvent and needed additives to an ionizing-radiation-hardening resin, and adjusting the viscosity of the mixture; the ink thus prepared is coated onto a substrate sheet by a known means such as the gravure, gravure-reverse or roll coating method, and then dried and hardened.

The ionizing-radiation-hardening resin is hardened by the application of radioactive rays such as ultraviolet rays or electron beams. The irradiation can be conducted by using a conventional technique as it is. For instance, in the case where the hardening of the resin is conducted by the application of an electron beam, an electron beam having an energy of 50 to 1,000 keV, preferably 100 to 300 keV, emitted by an electron beam accelerator such as a Cockcroft-Walton accelerator, a van de Graaff accelerator, an accelerator of tune transformer type, an accelerator of insulation core transformer type, a linear accelerator, an electro-curtain accelerator, a dynamitron accelerator, or a high-frequency accelerator is used.

In the case where the hardening of the resin is conducted by the application of ultraviolet rays, ultraviolet rays emitted by such a light source as an extra-high-, high-, or low-pressure mercury vapor lamp, a carbon or xenon arc lamp, or a metal halide lamp are used. The hardening of the resin by the application of ionizing radiation may be conducted either immediately after the ionizing-radiation-hardening resin ink is coated, or after the primer layer 24*b*, the ultraviolet- absorbing layer 24*c* and the adhesive layer 24*d* are formed. In the latter case, mixing or solvent attack which will be caused between the ionizing-radiation-hardening resin ink for forming the protective layer 24*a* which is not yet hardened and still soft and the ink for forming the ultraviolet-absorbing layer 24*c* can be effectively prevented by the primer layer 24*b*.

The primer layer 24*b*, which is a constituent of the transferable protective laminate 24, serves to increase the adhesion between the above-described protective layer 24*a* and the ultraviolet-absorbing layer 24*c*. It can also serve as a barrier layer capable of preventing solvent attack or mixing of resins which will be caused between the protective layer that is not yet hardened and still very soft, and the ultraviolet-absorbing layer during the formation of the transferable protective laminate 24.

Such a primer layer 24*b* can be formed by coating a solution of an acrylic resin such as methyl methacrylate or ethyl methacrylate onto the surface of the protective layer 24*a* by a known means such as the gravure, gravure-reverse or roll coating method, and drying the solution coated. The thickness of the primer layer 24*b* is approximately 0.1 to 5 micrometers.

The ultraviolet-absorbing layer 24*c*, which is a constituent of the transferable protective laminate 24, serves to impart improved light resistance to an image which has been transferred to an image-receiving material. This ultraviolet-absorbing layer 24*c* is characterized by comprising a resin which is combined with a reactive ultraviolet absorber by reaction. Specifically, it is possible to use a compound obtained by introducing, for example, addition-polymerizable double bond such as vinyl, acryloyl or methacryloyl group, or alcoholic hydroxyl, amino, carboxyl, epoxy or isocyanate group into a conventionally-known unreactive organic ultraviolet absorber such as a salicylate, benzophenone, benzotriazole, substituted-acrylonitrile, nickel-chelating or hindered amine ultraviolet absorber. More specifically, a reactive ultraviolet absorber having the following structural formula can be used:

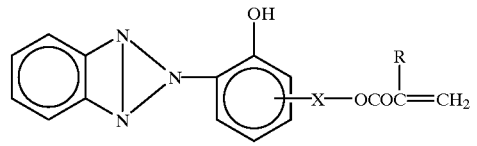

wherein R is H or $CH_3$, and

X is $—CH_2CH_2—$ or

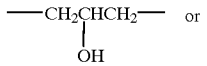

or

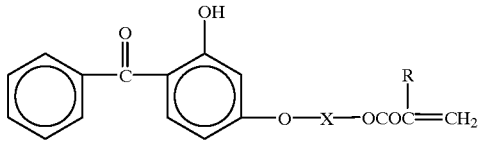

wherein R is H or $CH_3$, and

X is —$CH_2CH_2$— or

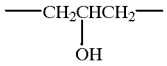

There are various methods for fixing the above-described reactive ultraviolet absorber to a resin. For instance, a resin component such as a known monomer, oligomer or reactive polymer, and the above-described reactive ultraviolet absorber having addition-polymerizable double bond can be subjected to radical polymerization to obtain a copolymer.

Further, in the case where the reactive ultraviolet absorber has hydroxyl, amino, carboxyl, epoxy or isocyanate group, a thermoplastic resin having a reactive group which can react with the above reactive group is allowed to react with the reactive ultraviolet absorber in the presence of, when necessary, a catalyst by the application of heat or the like. The reactive ultraviolet absorber can thus be fixed to the thermoplastic resin by reaction.

Examples of the monomer component which is copolymerized with the reactive ultraviolet absorber include methyl (meth)acrylate, ethyl (meth)acrylate, propyl (meth) acrylate, butyl (meth)acrylate, isobutyl (meth)acrylate, t-butyl (meth)acrylate, isodecyl (meth)acrylate, lauryl (meth)acrylate, lauryltridecyl (meth)acrylate, tridecyl (meth)acrylate, cerylstearyl (meth)acrylate, stearyl (meth) acrylate, ethylhexyl (meth)acrylate, octyl (meth)acrylate, cyclohexyl (meth)acrylate, benzyl (meth)acrylate, methacrylic acid, hydroxyethyl (meth)acrylate, hydroxypropyl (meth)acrylate, dimethylaminoethyl (meth)acrylate, diethylaminoethyl (meth)acrylate, t-butylaminoethyl (meth) acrylate, glycidyl (meth)acrylate, tetrahydrofurfuryl (meth) acrylate, ethylene di(meth)acrylate, diethylene glycol (meth) acrylate, triethylene glycol di(meth)acrylate, tetraethylene glycol di(meth)acrylate, decaethylene glycol (meth)acrylate, pentadecaethylene (meth)acrylate, pentacontahectaethylene glycol (meth)acrylate, butylene di(meth)acrylate, allyl (meth)acrylate, trimethylol-propane tri(meth)acrylate, hexanediol di(meth)acrylate, tripropylene glycol di(meth) acrylate, pentaerythritol tetra(meth)acrylate, pentaerythritol hexa(meth)acrylate, dipentaerythritol hexa(meth)acrylate, 1,6-hexanediol di(meth)acrylate, neopentyl glycol penta (meth)acrylate and phosphagen hexa(meth)acrylate.

The above-enumerated compounds can be used not only as monomers but also as oligomers. Moreover, acrylic reactive polymers such as polyester acrylate polymers and epoxy acrylate polymers, which are polymers of the above compounds, or derivatives of the polymers can also be used.

These monomers, oligomers and acrylic reactive polymers can be used either singly or in combination.

By copolymerizing the above-described monomer, oligomer or acrylic reactive polymer with the reactive ultraviolet absorber, a thermoplastic copolymer resin to which the reactive ultraviolet absorber is fixed can be obtained. By the use of this copolymer resin, the ultraviolet-absorbing layer 24*c* is formed.

The above copolymer resin contains 10 to 90% by weight, preferably 30 to 70% by weight of the reactive ultraviolet absorber. When a copolymer resin containing less than 10% by weight of the reactive ultraviolet absorber is used, the resulting ultraviolet-absorbing layer 24*c* cannot show sufficiently high light resistance. On the other hand, when a copolymer resin containing more than 90% by weight of the reactive ultraviolet absorber is used, the coating solution for forming the ultraviolet-absorbing layer 24*c* becomes rather sticky, and an image transferred to an image-receiving material, covered with the transferable protective laminate will be blurred.

The above copolymer resin has a molecular weight of approximately 5,000 to 250,000, more preferably about 9,000 to 30,000. When a copolymer resin having a molecular weight of less than 5,000 is used, the resulting ultraviolet-absorbing layer 24*c* is insufficient in film strength. On the other hand, when a copolymer resin having a molecular weight of more than 250,000 is used, the resulting ultraviolet-absorbing layer 24*c* is not clearly cut when it is transferred to an image-receiving material.

The ultraviolet-absorbing layer 24*c* may also be formed by the combination use of the above-described copolymer resin and a known organic ultraviolet absorber such as a benzophenone, benzotriazole, salicylate or hindered amine ultraviolet absorber, or a known inorganic ultraviolet absorber such as titanium oxide, zinc oxide or cerium oxide.

The ultraviolet-absorbing layer 24*c* can be formed by a known means such as the gravure, gravure-reverse or roll coating method. The thickness of the ultraviolet-absorbing layer 24*c* is approximately 0.1 to 8 micrometers, preferably about 1 to 5 micrometers.

The adhesive layer 24*d*, which is a constituent of the transferable protective laminate 24, can be formed in the same manner as in the formation of the adhesive layer 14*b*, which is a constituent of the transferable protective laminate 14 of the previously-mentioned thermal transfer printing sheet 11. Therefore, an explanation for this layer is omitted here.

The hot-melt ink layer 27 contained in the area 26 for reverse transfer printing of the thermal transfer printing sheet 21 is provided by laminating a releasing OP layer 27*a* and a coloring ink layer 27*b* on the substrate sheet 2 in this order. The transferable protective laminate 28 contained in the area 26 for reverse transfer printing is provided by laminating a protective layer 28*a*, a primer layer 28*b*, an ultraviolet-absorbing layer 28*c* and an adhesive layer 28*d* on the substrate sheet 2 in this order. The releasing OP layer 27*a* and the coloring ink layer 27*b* can be formed in the same manner as in the formation of the releasing OP layer 17*a* and the coloring ink layer 17*b* of the previously-mentioned thermal transfer printing sheet 11. Therefore, explanations for these layers are omitted here. Further, the protective layer 28*a*, the primer layer 28*b*, the ultraviolet-absorbing layer 28*c* and the adhesive layer 28*d* of the transferable protective laminate 28 can be formed in the same manner as in the formation of the protective layer 24*a*, the primer layer 24*b*, the ultraviolet-absorbing layer 24*c* and the adhesive layer 24*d* of the above-described transferable protective laminate 24. Therefore, explanations for these layers are omitted here.

Figure 7:
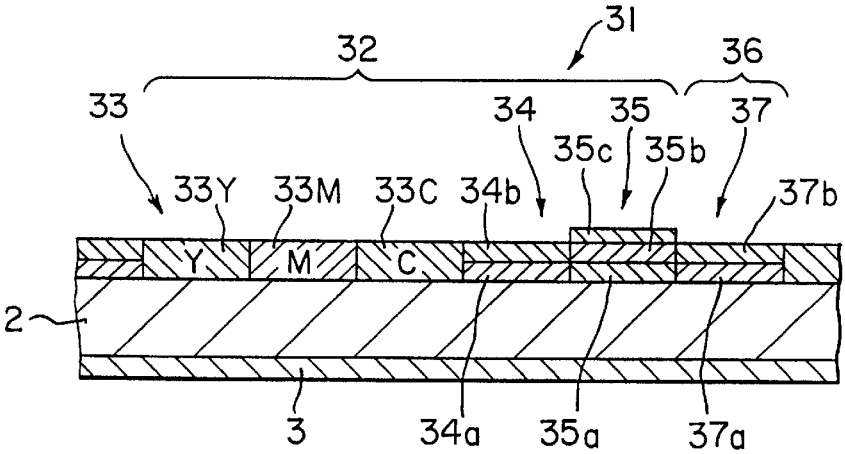
FIG. 7 is a diagrammatic cross-sectional view showing the structure of the thermal transfer printing sheet shown in FIG. 3.

FIG. 7 is a diagrammatical sectional view showing the structure of the thermal transfer printing sheet 31 shown in FIG. 3. As shown in this figure, the thermal transfer printing sheet 31 has an area 32 for surface transfer printing and an area 36 for reverse transfer printing, which are alternately provided on one surface of a substrate sheet 2. Further, a backing layer 3 is provided on the other surface of the substrate sheet 2. The substrate sheet 2 and the backing layer 3 are the same as those of the previously-mentioned thermal transfer printing sheet 11. Therefore, explanations for them are omitted here.

The area 32 for surface transfer printing of the thermal transfer printing sheet 31 consists of a sublimable dye layer 33 (33Y, 33M, 33C), a hot-melt ink layer 34, and a transferable protective laminate 35. The sublimable dye layer 33 and the hot-melt ink layer 34 can be formed in the same manner as in the formation of the sublimable dye layer 13 and the hot-melt ink layer 17 of the thermal transfer printing sheet 11, respectively. Therefore, explanations for these layers are omitted here.

The transferable protective laminate 35 contained in the area 32 for surface transfer printing is provided by laminating a protective layer 35*a*, an ultraviolet-absorbing layer 35*b* and an adhesive layer 35*c* on the substrate sheet 2 in this order.

The protective layer 35*a*, which is a constituent of the transferable protective laminate 35, comprises as a main component a mixture of polymethyl methacrylate (PMMA) and a wax.

PMMA is excellent in transparency, and can produce a relatively strong film. Therefore, it can impart hardness, and durability such as scratch resistance and chemical resistance to the protective layer 35*a*. Further, since a wax is incorporated into the protective layer 35*a*, the transferable protective laminate 35 is clearly cut when it is transferred to an image-receiving material.

The wax incorporated into the protective layer 35*a* serves to impart thereto slip properties. Examples of the wax which can be used include microcrystalline wax, carnauba wax, paraffin wax, Fischer-Tropsh wax, a variety of low-molecular weight polyethylenes, Japanese wax, bees wax, spermaceti, insect wax, wool wax, shellac wax, candellia wax, petrolatum, partially-modified waxes, fatty esters, and fatty amides.

It is preferable to use the above-described wax in an amount of 1 to 20 parts by weight for 100 parts by weight of PMMA. When the wax is used in an amount of less than 1 part by weight for 100 parts by weight of PMMA, the resulting protective layer 35*a* cannot have sufficiently high scratch resistance. On the other hand, when the wax is used in an amount of more than 20 parts by weight, the resulting protective layer 35*a* is poor in durability and transparency.

Substantially transparent inorganic or organic fine particles can also be incorporated into the protective layer 35*a*. When such fine particles are incorporated into the protective layer 35*a*, the transferable protective laminate 35 is more clearly cut when it is thermally transferred to an image-receiving material, and the scratch resistance and the like of the protective layer 35*a* are also improved. In addition, the surface gloss of the protective layer 35*a* is reduced, so that the protective layer is to have a matte surface. Examples of the fine particles include those ones which have relatively high transparency, such as silica, Teflon powder and nylon powder. It is preferable to use the fine particles in an amount of 10 to 30% by weight of PMMA. When the fine particles are used in an amount of more than 30% by weight of PMMA, the resulting protective layer 35*a* has decreased transparency and durability.

Further, when such additives as an ultraviolet absorber, an antioxidant and a fluorescent brightener are incorporated into the protective layer 35*a*, an image transferred to an image-receiving material, covered with the protective layer 35*a* has improved gloss, light resistance, weather resistance, whiteness and the like.

The protective layer 35*a* can be formed on the substrate sheet 2 in the following manner: an ink is prepared by mixing PMMA, a wax, and, when necessary, additives; the ink thus prepared is coated onto a substrate sheet by a known means such as the gravure, gravure-reverse or roll coating method, and then dried. The thickness of the protective layer 35*a* is approximately 0.5 to 10 micrometers, preferably about 1 to 5 micrometers.

There is no particular limitation on the method for mixing PMMA and the wax, and it is possible to employ a method in which after both of PMMA and the wax are separately melted, the melted PMMA and wax are mixed with each other; or a method in which PMMA and the wax are dissolved in a proper organic solvent in which both of them are soluble. A particularly preferable method is such that a dispersion (emulsion) of PMMA is mixed with a solution or dispersion (emulsion) of the wax. The dispersion (emulsion) obtained in such a manner is coated onto the substrate sheet 2, and then dried at a relatively low temperature (50 to 100° C.) so that at least a part of the resin particles can remain as they are, thereby forming the protective layer 35*a*. Since some of the resin particles are remaining as they are in this protective layer 35*a*, the surface of the protective layer 35*a* is rough and partially opaque. However, the surface of the protective layer 35*a* after transferred to an image-receiving material is smooth and transparent because heat and pressure are applied to the protective layer in order to transfer it to the image-receiving material. In addition, since some of the resin particles are remaining in the protective layer 35*a*, the protective layer 35*a* is clearly cut when it is thermally transferred to an image-receiving material.

The ultraviolet-absorbing layer 35*b*, which is a constituent of the transferable protective laminate 35, can be formed in the same manner as in the formation of the ultraviolet-absorbing layer 24*c*, which is a constituent of the transferable protective laminate 24 of the previously-mentioned thermal transfer printing sheet 21. Therefore, an explanation for this layer is omitted here.

The adhesive layer 35*c*, a constituent of the transferable protective laminate 35 of the thermal transfer printing sheet 31, serves to make the transferable protective laminate 35 easily transfer to an image-receiving material. A hot-melt adhesive resin such as an acrylic resin, a vinyl chloride resin, a vinyl chloride-vinyl acetate copolymer, an acryl-vinyl chloride-vinyl acetate terpolymer, a polyester resin or a polyamide resin can be used as an adhesive component of the adhesive layer 35*c*. The adhesive layer 35*c* can be formed by a known means. The thickness of the adhesive layer 35*c* is preferably about 0.5 to 10 micrometers.

Further, such additives as an antioxidant and a fluorescent brightener may also be incorporated into the adhesive layer 35*c*.

It is possible to make the structure of the thermal transfer printing sheet 41 of the present invention shown in FIG. 4 the same as that of the thermal transfer printing sheet 31 except that a transferable protective laminate 48 is formed on an area 46 for reverse transfer printing in the same manner as in the formation of the transferable protective laminate 35 provided on the area 32 for surface transfer printing of the above-described thermal transfer printing sheet 31.

The transferable protective laminates 14, 24, 28 and 35 of different structures are shown in FIGS. 5 to 7. The transferable protective laminate of the thermal transfer printing sheet according to the present invention can be of any of these structures.

All of the above-described thermal transfer printing sheets of the present invention have a sublimable dye layer composed of sections of three colors of yellow (Y), magenta (M) and cyan (C). However, the thermal transfer printing sheets of the present invention are not limited to these three colors, and a sublimable dye layer of a desired color can be provided depending upon the intended use of the thermal transfer printing sheet.

<Process of Double-Side Transfer Printing of the Invention (One-Roll Type)>

A process of double-side transfer printing according to the present invention, using a thermal transfer printing sheet of the invention will now be described.

First of all, a process of double-side transfer printing, using the thermal transfer printing sheet 11 shown in FIG. 1 will be explained. In this process, the thermal transfer printing sheet 11 is firstly superposed on an image-receiving material with the sublimable dye layer 13Y of the thermal transfer printing sheet 11 and the surface of the image-receiving material faced each other. Heat and pressure are then applied to the thermal transfer printing sheet 11 by a heating means such as a thermal head which is generating heat according to image information, thereby transferring the yellow sublimable dye to the surface of the image-receiving material. This procedure is repeated by using the sublimable dye layers 13M and 13C. A full-colored image with gradation is thus formed on the surface of the image-receiving material. Subsequently, the transferable protective laminate 14 of the thermal transfer printing sheet 11 is transferred to the desired part of the surface of the image-receiving material so that the image with gradation can be covered with the transferable protective laminate 14. Thus, transfer printing using the area 12 for surface transfer printing of the thermal transfer printing sheet 11 is completed.

Thereafter, either the image-receiving material is turned over, or the thermal printer is reversed. By doing so, the thermal transfer printing sheet is superposed on the image-receiving material with the hot-melt ink layer 17 of the thermal transfer printing sheet 11 and the back of the image-receiving material faced each other. Heat and pressure are then applied to the thermal transfer printing sheet 11 by a heating means such as a thermal head which is generating heat according to the predetermined data, whereby the hot-melt ink layer 17 is transferred to the back of the image-receiving material to form thereon monotone letters, symbols or the like. Thus, transfer printing using the area 16 for reverse transfer printing of the thermal transfer printing sheet 11 is completed. By the use of the next pair of the area 12 for surface transfer printing and the area 16 for reverse transfer printing of the thermal transfer printing sheet 11, double-side transfer printing can be conducted on the next image-receiving material.

A process of double-side transfer printing, using the thermal transfer printing sheet 21 shown in FIG. 2 will be explained. The thermal transfer printing sheet 21 is superposed on the surface of an image-receiving material, and a full-colored image with gradation is formed on the surface of the image-receiving material by using the sublimable dye layers 23Y, 23M and 23C in the same manner as in the above-described process in which the thermal transfer printing sheet 11 is used. Next, the transferable protective laminate 24 of the thermal transfer printing sheet 21 is transferred to the desired part of the surface of the image-receiving material so that the image with gradation can be covered with the transferable protective laminate 24. Thus, transfer printing using the area 22 for surface transfer printing of the thermal transfer printing sheet 21 is completed.

Thereafter, either the image-receiving material is turned over, or the thermal printer is reversed. By doing so, the thermal transfer printing sheet 21 is superposed on the image-receiving material with the hot-melt ink layer 27 of the thermal transfer printing sheet 21 and the back of the image-receiving material faced each other. Heat and pressure are then applied to the thermal transfer printing sheet 21 by a heating means such as a thermal head which is generating heat according to the predetermined data, whereby the hot-melt ink layer 27 is transferred to the back of the image-receiving material to form thereon monotone images such as letters, symbols or the like. Subsequently, the transferable protective laminate 28 of the thermal transfer printing sheet 21 is transferred to the desired part of the surface of the image-receiving material so that the monotone images can be covered with the transferable protective laminate 28. Thus, transfer printing using the area 26 for reverse transfer printing of the thermal transfer printing sheet 21 is completed. By the use of the next pair of the area 22 for surface transfer printing and the area 26 for reverse transfer printing of the thermal transfer printing sheet 21, double-side transfer printing can be conducted on the next image-receiving material.

A process of double-side transfer printing, using the thermal transfer printing sheet 31 shown in FIG. 3 will be explained. The thermal transfer printing sheet 31 is superposed on the surface of an image-receiving material, and a full-colored image with gradation is formed on the surface of the image-receiving material by using the sublimable dye layers 33Y, 33M and 33C in the same manner as in the aforementioned process in which the thermal transfer printing sheet 11 is used. Next, the thermal transfer printing sheet 31 is superposed on the image-receiving material with the hot-melt ink layer 34 of the thermal transfer printing sheet 31 and the surface of the image-receiving material faced each other. Heat and pressure are then applied to the thermal transfer printing sheet 31 by a heating means such as a thermal head which is generating heat according to the predetermined data, whereby the hot-melt ink layer 34 is transferred to the surface of the image-receiving material to form thereon monotone images such as letters, symbols or the like. Subsequently, the transferable protective laminate 35 of the thermal transfer printing sheet 31 is transferred to the desired part of the surface of the image-receiving material so that at least the image with gradation can be covered with the transferable protective laminate 35. Thus, transfer printing using the area 32 for surface transfer printing of the thermal transfer printing sheet 31 is completed.

Thereafter, either the image-receiving material is turned over, or the thermal printer is reversed. By doing so, the thermal transfer printing sheet 31 is superposed on the image-receiving material with the hot-melt ink layer 37 of the thermal transfer printing sheet 31 and the back of the image-receiving material faced each other. Heat and pressure are then applied to the thermal transfer printing sheet 31 by a heating means such as a thermal head which is generating heat according to the predetermined data, whereby the hot-melt ink layer 37 is transferred to the back of the image-receiving material to form thereon monotone images such as letters, symbols or the like. Thus, transfer printing using the area 36 for reverse transfer printing of the thermal transfer printing sheet 31 is completed. By the use of the next pair of the area 32 for surface transfer printing and the area 36 for reverse transfer printing of the thermal transfer printing sheet 31, double-side transfer printing can be conducted on the next image-receiving material.

A process of double-side transfer printing, using the thermal transfer printing sheet 41 shown in FIG. 4 will be explained. The thermal transfer printing sheet 41 is superposed on the surface of an image-receiving material, and a full-colored image with gradation is formed on the surface of the image-receiving material by using the sublimable dye layers 43Y, 43M and 43C in the same manner as in the previously-mentioned process in which the thermal transfer printing sheet 11 is used. Next, the thermal transfer printing sheet 41 is superposed on the image-receiving material with the hot-melt ink layer 44 of the thermal transfer printing sheet 41 and the surface of the image-receiving material faced each other. Heat and pressure are then applied to the thermal transfer printing sheet 41 by a heating means such as a thermal head which is generating heat according to the predetermined data, whereby the hot-melt ink layer 44 is transferred to the surface of the image-receiving material to form thereon monotone images such as letters, symbols or the like. Subsequently, the transferable protective laminate 45 of the thermal transfer printing sheet 41 is transferred to the desired part of the surface of the image-receiving material so that at least the image with gradation can be covered with the transferable protective laminate 45. Thus, transfer printing using the area 42 for surface transfer printing of the thermal transfer printing sheet 41 is completed.

Thereafter, either the image-receiving material is turned over, or the thermal printer is reversed. By doing so, the thermal transfer printing sheet 41 is superposed on the image-receiving material with the hot-melt ink layer 47 of the thermal transfer printing sheet 41 and the back of the image-receiving material faced each other. Heat and pressure are then applied to the thermal transfer printing sheet 41 by a heating means such as a thermal head which is generating heat according to the predetermined data, whereby the hot-melt ink layer 47 is transferred to the back of the image-receiving material to form thereon monotone images such as letters, symbols or the like. Subsequently, the transferable protective laminate 48 of the thermal transfer printing sheet 41 is transferred to the desired part of the back of the image-receiving material so that the monotone images can be covered with the transferable protective laminate 48. Thus, transfer printing using the area 46 for reverse transfer printing of the thermal transfer printing sheet 41 is completed. By the use of the next pair of the area 42 for surface transfer printing and the area 46 for reverse transfer printing of the thermal transfer printing sheet 41, double-side transfer printing can be conducted on the next image-receiving material.

In any of the above-described processes of double-side transfer printing, using the thermal transfer printing sheet 11, 21, 31 or 41, the thermal transfer printing sheet is used without unused areas being left when thermal transfer printing is conducted on the surface of an image-receiving material by using the area for surface transfer printing, and on the back of the image-receiving material by using the area for reverse transfer printing. Therefore, the efficiency of double-side transfer printing conducted by using any of the processes of the present invention is extremely high.

In all of the above-described processes of double-side transfer printing, an image is firstly formed on the surface of an image-receiving material by using the area for surface transfer printing of the thermal transfer printing sheet. However, it is a matter of course that an image can be firstly formed on the back of an image-receiving material by using the area for reverse transfer printing.

In the above stated processes of double-side transfer printing, either the image-receiving material or the thermal printer is reversed. However, it is more practical to reverse the image-receiving material than the thermal printer. How the image-receiving material is reversed will be described below.

Figure 10:
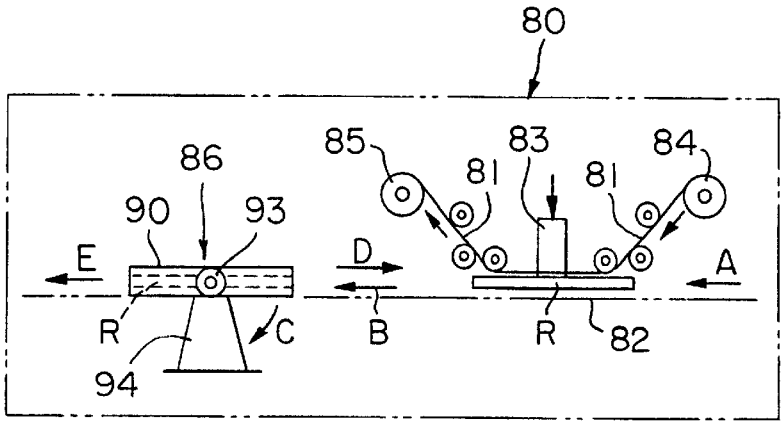
FIG. 10 is a schematic front view showing an apparatus for carrying out the process of double-side transfer printing of the present invention.

FIG. 10 illustrates a schematic view of a thermal printer 80 in which an image-receiving material is reversed for reverse transfer printing. The image-receiving material shown is a card R such as a credit card or a bank card. The image-receiving material R is sent into the thermal printer 80 as indicted by an arrow A. The image-receiving material R may be conveyed in the thermal printer 80 by means of a roll conveyor 82 in which the image-receiving material R is sent through nips between vertically opposed rolls 87 (FIG. 11) forming pairs.

The image-receiving material R sent into the thermal printer 80 first comes under a thermal head 83 which receives electronic signals corresponding to images to be produced as is known in the art. A thermal transfer printing sheet 81, which is one of the thermal transfer printing sheets 11, 21, 31 and 41 as shown in FIGS. 1, 2, 3 and 4, is paid out from a supply roll 84, passed between the thermal head 83 and the image-receiving material R and then wound around a take-up roll 85 after being used for transfer printing. The thermal head 83 applies heat and pressure to the thermal transfer printing sheet 81 to transfer images to the upper front surface of the image-receiving material R as has been described hereinbefore.

Figure 11:
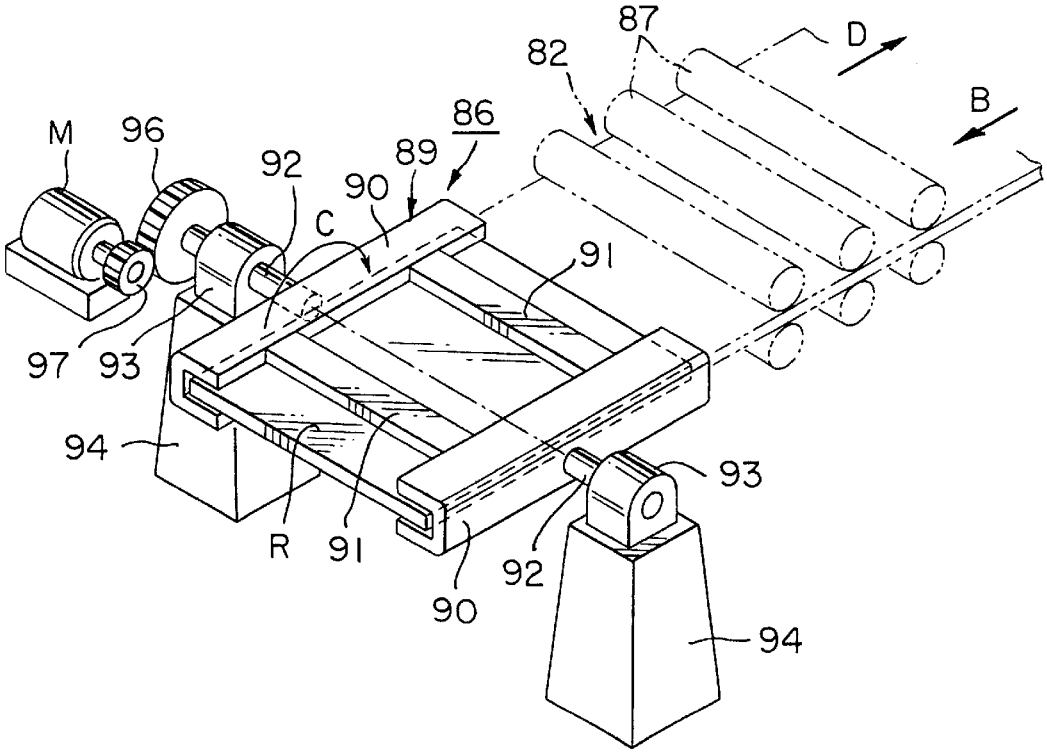
Figure 12:
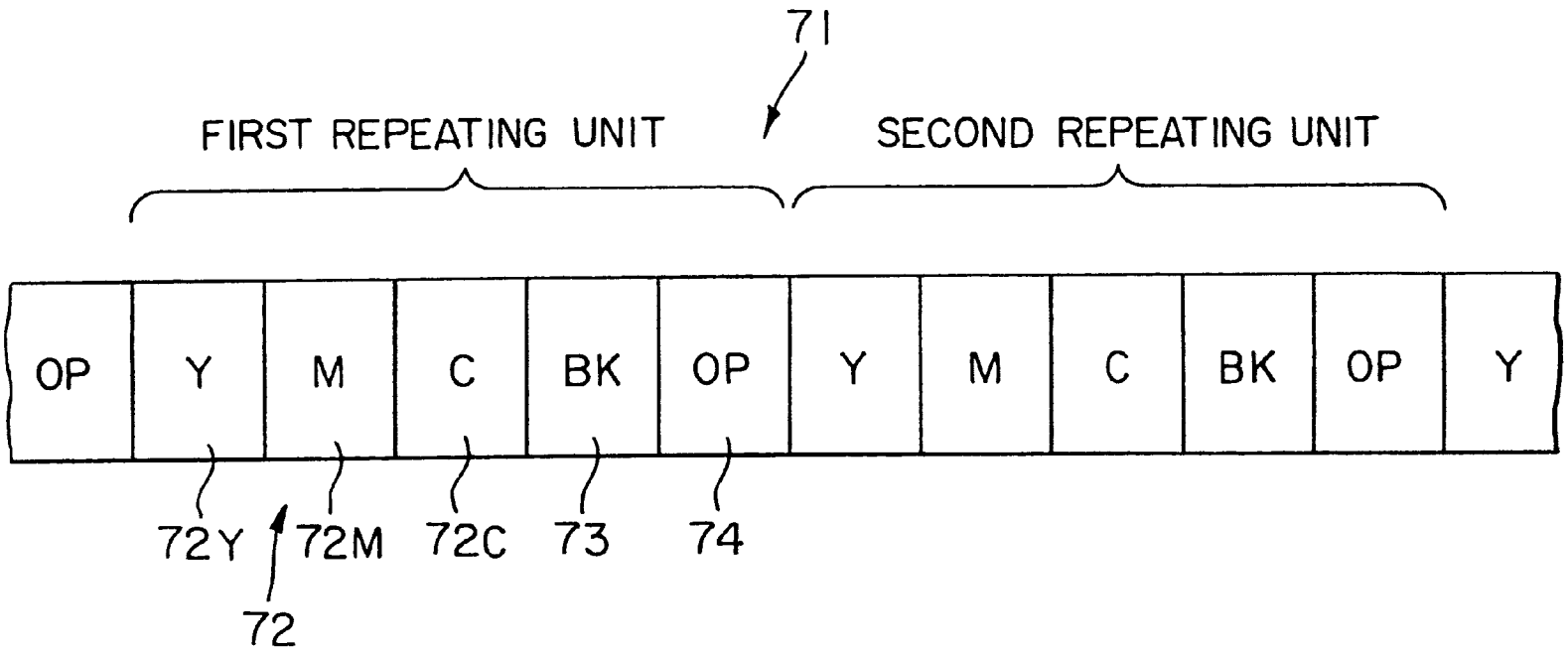
FIG. 12 PRIOR ART
FIG. 12 is a plan view showing a thermal transfer printing sheet for use in the conventional process of double-side transfer printing.

After the image transfer operation onto the front surface of the image-receiving material has been carried out, the thermal head 83 is raised away from the image-receiving material R which is thereafter conveyed to a reversing unit 86 as indicated by an arrow B. The reversing unit 86 is shown in FIG. 11. As shown in this figure, the conveyor 82 includes upper and lower conveyor rolls 87 between which the image-receiving material R is conveyed horizontally. The reversing unit 86 is provided to reverse the image-receiving material R so that the lower back surface of the image-receiving material R will face upward and the upper front surface will face downward.

The reversing unit 86 has a rotary holder 89 for holding the image-receiving material R therein. The rotary holder 89 includes a pair of opposite guide channel members 90 which extend in parallel in the direction of conveyance of the image-receiving material R. These guide channel members 90 have their guide grooves therein opening toward each other. The guide channel members 90 are fixedly connected by cross members 91. The rotary holder 89 is provided with coaxial rotary shafts 92 extending outward from the guide channel members 90 in directions perpendicular to the direction of conveyance of the image-receiving material R, respectively. Each rotary shaft 92 is fixedly provided at an intermediate position of the length of each guide channel member 90.

The rotary shafts 92 are rotatably supported by stationary bearings 93 which are mounted on stands 94, respectively. One of the rotary shafts 92 has a driven gear 96 fixed thereto which is in mesh with a driving pinion 97 secured to the output shaft of a rotary actuator M. When the actuator M is operated, the rotary shafts 92 are rotated at a reduced speed via the pinion 97 and the gear 96. These pinion and gear may be replaced by any other transmission means. The rotation of the shafts 92 causes the rotary holder 89 to be rotated accordingly.

The image-receiving material R which has been subjected to thermal transfer printing on the upper front surface (first surface) thereof is conveyed in the direction of the arrow B in FIG. 10. The image-receiving material R thus conveyed is inserted into the opposite grooves of the guide channel members 90 of the rotary holder 89 which is in the horizontal attitude shown in FIG. 11. The image-receiving material R which has thus been inserted in the rotary holder 89 is shown in FIG. 11. This image-receiving material R inserted in the rotary holder 89 has the front surface which is directed upward and which has an image applied thereto.

Thereafter, the rotary actuator M is operated and the rotary holder 89 is rotated at a reduced speed around the axis of the rotary shafts 92. The rotational direction of the rotary holder 89 may be as indicated by an arrow C in FIG. 11, but the rotary holder 89 may be rotated in the opposite direction.

When the rotary holder 89 is rotated through an angle of 180°, the image-receiving material R therein is also rotated 180° so that the front surface of the image-receiving material R is directed downward, while the back surface (second surface) of the image-receiving material R is directed upward. As a result, the image-receiving material R is reversed.

The image-receiving material R held in the rotary holder 89 is then pushed in the direction of an arrow D out of the rotary holder 89 and sent back to the location under the thermal head 83. The pushing operation of the image-receiving sheet R may be performed by a pushing member not shown. The conveying operation of the image-receiving material R is performed by rotating the conveyor rolls 87 in the opposite directions.

The image-receiving sheet R, which has been brought back to the location under the thermal head 83, is subjected to transfer printing on the back surface thereof. For this operation, the thermal transfer printing sheet 81 is fed to cause a different area thereof to face the back surface of the image-receiving material R, and the thermal head 83 is lowered to apply pressure and heat to the thermal transfer printing sheet 81 superposed on the image-receiving material R.

The image-receiving material R, which has been subjected to the thermal transfer printing on the back surface thereof, is then conveyed in the direction of the arrow B. The image-receiving material R is passed through the grooves of the rotary holder 89 and sent in the direction of an arrow E in FIG. 10 to be taken out of the thermal printer 80. It is to be noted that the rotary holder 89 need not be turned back to the original rotational position after the rotary holder 89 has been rotated 180°, but the rotary holder 89 may be turned for a further angle of 180° in the same rotational direction. Thus, the rotational operation of the rotary holder 89 can be performed without using a reversible rotary actuator at relatively low cost and in a reliable manner.

It is to be understood that although the sublimable dye layer is first transfer printed on the front surface of the image-receiving material and thereafter the hot-melt ink layer is transfer printed on the back surface of the image-receiving material in the above-described embodiment, the hot-melt ink layer may be first transfer printed and then the sublimable dye layer may be transfer printed.

<Process of Double-Side Transfer Printing of the Invention (Two-Roll. Type)>

In all of the above-described processes of double-side transfer printing, only one thermal transfer printing sheet is used. A process of double-side transfer printing according to the present invention, using two thermal transfer printing sheets will now be explained.

Figure 8:
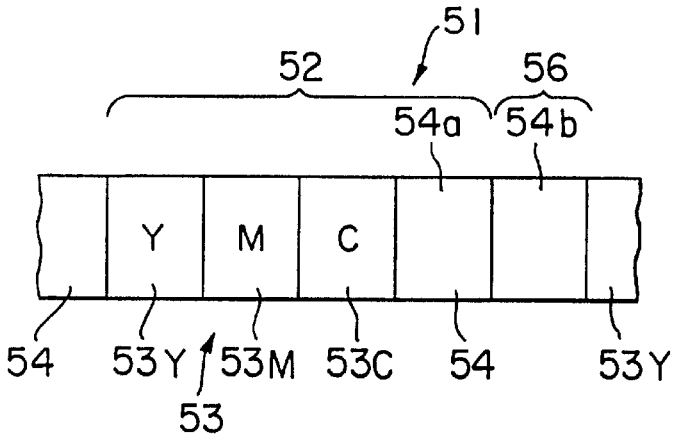
FIGS. 8(A) and 8(B) are plan vie ws showing a pair of thermal transfer printing sheets for use in the process of double-side transfer printing of the present invention.
Figure 8:
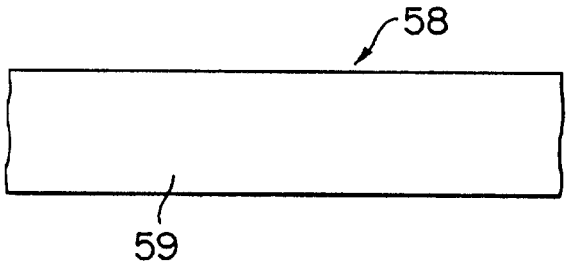

FIGS. 8(A) and 8(B) are plan views showing a pair of thermal transfer printing sheets for use in a process of double-side transfer printing according to the present invention. A first thermal transfer printing sheet 51 shown in FIG. 8(A) contains a sublimable dye layer 53 composed of sections (53Y, 53M, 53C) of three colors of yellow, magenta and cyan, and a hot-melt ink layer 54, which are alternately provided on one surface of a substrate sheet. The area of the hot-melt ink layer 54 is twice as large as that of the section of each color of the sublimable dye layer 53. The first half 54*a* of the hot-melt ink layer 54 (a half of the hot-melt ink layer 54, provided next to the sublimable dye layer 53) is used when an image is transferred to the surface of an image-receiving material, and the second half 54*b* of the hot-melt ink layer 54 is used when an image is transferred to the back of the image-receiving material. Namely, the first thermal transfer printing sheet 51 has an area 52 for surface transfer printing, composed of the sublimable dye layer 53 and the first half 54*a* of the hot-melt ink layer 54, and an area 56 for reverse transfer printing, composed of the second half 54*b* of the hot-melt ink layer 54. It is possible to make these sublimable dye layer 53 and hot-melt ink layer 54 the same as those of the aforementioned thermal transfer printing sheets of the present invention.

On the other hand, a second thermal transfer printing sheet 58 shown in FIG. 8(B) contains a transferable protective laminate 59 provided on a substrate sheet. It is possible to make this transferable protective laminate 59 the same as that of the aforementioned thermal transfer printing sheets of the present invention.

A process of double-side transfer printing of the present invention, using the above-described first thermal transfer printing sheet 51 and second thermal transfer printing sheet 58 are as follows. An image-receiving material is firstly fed to a thermal printer in which the first thermal transfer printing sheet 51 is set, whereby the first thermal transfer printing sheet 51 is superposed on the image-receiving material with the sublimable dye layer 53Y of the thermal transfer printing sheet 51 and the surface of the image-receiving material faced each other. Heat and pressure are then applied to the thermal transfer printing sheet 51 by a heating means such as a thermal head which is generating heat according to image data, thereby transferring the yellow sublimable dye to the surface of the image-receiving material. This procedure is repeated by using the sublimable dye layers 53M and 53C of the thermal transfer printing sheet 51. A full-colored image with gradation is thus formed on the surface of the image-receiving material. Thereafter, the thermal transfer printing sheet 51 is superposed on the image-receiving material with the first half 54*a* of the hot-melt ink layer 54 of the thermal transfer printing sheet 51 and the surface of the image-receiving material faced each other. Heat and pressure are then applied to the thermal transfer printing sheet 51 by a heating means such as a thermal head which is generating heat according to the predetermined data, whereby the hot-melt ink layer 54*a* is transferred to the surface of the image-receiving material to form thereon monotone images such as letters, symbols or the like. Thus, transfer printing using the area 52 for surface transfer printing of the first thermal transfer printing sheet 51 is completed.

Thereafter, this image-receiving material is fed to a thermal printer in which the second thermal transfer printing sheet 58 is set, whereby the second thermal transfer printing sheet 58 is superposed on the image-receiving material with the transferable protective laminate 59 of the thermal transfer printing sheet 58 and the surface of the image-receiving material faced each other. The transferable protective laminate 58 is then transferred to the desired part of the surface of the image-receiving material so that at least the image with gradation can be covered with the transferable protective laminate 58.

Next, either the image-receiving material is turned over, or the thermal printer in which the first thermal transfer printing sheet 51 is set is reversed. The image-receiving material is fed again to this thermal printer, whereby the first thermal transfer printing sheet 51 is superposed on the image-receiving material with the second half 54*b* of the hot-melt ink layer 54 of the first thermal transfer printing sheet 51 and the back of the image-receiving material faced each other. Heat and pressure are then applied to the first thermal transfer printing sheet 51 by a heating means such as a thermal head which is generating heat according to the predetermined data, whereby the hot-melt ink layer 54*b* is transferred to the back of the image-receiving material to form thereon monotone images such as letters, symbols or the like. Thus, transfer printing using the area 56 for reverse transfer printing of the first thermal transfer printing sheet 51 is completed. It is noted that the following procedure can also be carried out: after the monotone images are formed on the back of the image-receiving material by using the first thermal transfer printing sheet 51, the image-receiving material is fed to the thermal printer in which the second transfer printing sheet is set, and the transferable protective laminate 59 is transferred to the desired part of the back of the image-receiving material so that the monotone images can be covered with the transferable protective laminate 58.

In the above-described process of double-side transfer printing, using the first thermal transfer printing sheet 51 and the second thermal transfer printing sheet 58 in combination, the thermal transfer printing sheets are used without unused areas being left when images are formed on both surfaces of an image-receiving material. Therefore, the efficiency of double-side transfer printing conducted by this process is extremely high.

Another process of double-side transfer printing of the present invention, using two thermal transfer printing sheets will be explained.

Figure 9:
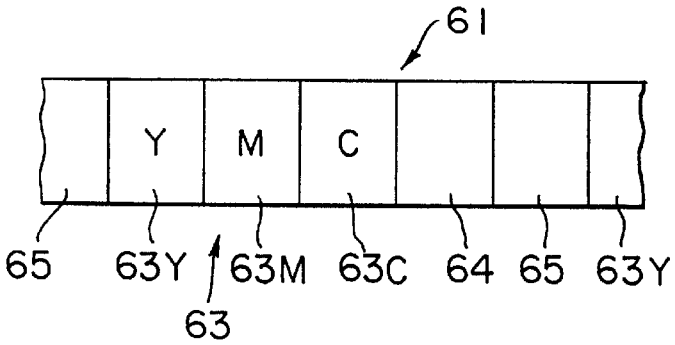
FIGS. 9(A) and 9(B) are plan views showing another pair of thermal transfer printing sheets for use in the process of double-side transfer printing of the present
Figure 9:
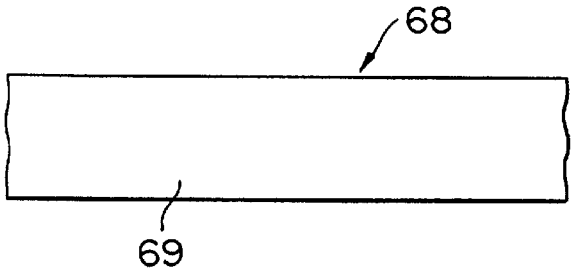

FIGS. 9(A) and 9(B) are plan views showing a pair of thermal transfer printing sheets for use in a process of double-side transfer printing according to the present invention. A first thermal transfer printing sheet 61 shown in FIG. 9(A) contains a sublimable dye layer 63 composed of sections (63Y, 63M, 63C) of three colors of yellow, magenta and cyan, a hot-melt ink layer 64, and a transferable protective laminate 65, which are sequentially provided on one surface of a substrate sheet. It is possible to make these sublimable dye layer 63, hot-melt ink layer 64 and transferable protective laminate 65 the same as those of the aforementioned thermal transfer printing sheets of the present invention. Alternatively, a conventional thermal transfer printing sheet of the same structure can be used as it is as the first thermal transfer printing sheet 61.

On the other hand, a second thermal transfer printing sheet 68 shown in FIG. 9(B) contains a hot-melt ink layer 69 provided on a substrate sheet. It is possible to make this hot-melt ink layer 69 the same as that of the aforementioned thermal transfer printing sheets of the present invention.

The process of double-side transfer printing of the present invention, using the above-described first thermal transfer printing sheet 61 and second thermal transfer printing sheet 68 is as follows. An image-receiving material is firstly fed to a thermal printer in which the first thermal transfer printing sheet 61 is set, whereby the first thermal transfer printing sheet 61 is superposed on the image-receiving material with the sublimable dye layer 63Y of the thermal transfer printing sheet 61 and the surface of the image-receiving material faced each other. Heat and pressure are then applied to the thermal transfer printing sheet 61 by a heating means such as a thermal head which is generating heat according to image data, thereby transferring the yellow sublimable dye to the surface of the image-receiving material. This procedure is repeated by using the sublimable dye layers 63M and 63C of the first thermal transfer printing sheet 61. A full-colored image with gradation is thus formed on the surface of the image-receiving material. Thereafter, the first thermal transfer printing sheet 61 is superposed on the image-receiving material with the hot-melt ink layer 64 of the thermal transfer printing sheet 61 and the surface of the image-receiving material faced each other. Heat and pressure are then applied to the thermal transfer printing sheet 61 by a heating means such as a thermal head which is generating heat according to the predetermined data, whereby the hot-melt ink layer 64 is transferred to the surface of the image-receiving material to form thereon monotone images such as letters, symbols or the like. Thereafter, the first thermal transfer printing sheet 61 is superposed on the image-receiving material with the transferable protective laminate 65 of the first thermal transfer printing sheet 61 and the surface of the image-receiving material faced each other. The transferable protective laminate 65 is then transferred to the desired part of the surface of the image-receiving material so that at least the image with gradation can be covered with the transferable protective laminate 65. Thus, transfer printing using the first thermal transfer printing sheet 61 is completed.

Next, either the image-receiving material is turned over, or the thermal printer in which the second thermal transfer printing sheet 68 is set is reversed against the thermal printer in which the first thermal transfer printing sheet 61 is set. The image-receiving material is fed to the thermal printer in which the second thermal transfer printing sheet 68 is set, whereby the second thermal transfer printing sheet 68 is superposed on the image-receiving material with the hot-melt ink layer 69 of the second thermal transfer printing sheet 68 and the back of the image-receiving material faced each other. Heat and pressure are then applied to the thermal transfer printing sheet 68 by a heating means such as a thermal head which is generating heat according to the predetermined data, whereby the hot-melt ink layer 69 is transferred to the back of the image-receiving material to form thereon monotone images such as letters, symbols or the like. Thus, transfer printing using the second thermal transfer printing sheet 68 is completed.

In the above-described process of double-side transfer printing, using the first thermal transfer printing sheet 61 and the second thermal transfer printing sheet 68 in combination, the thermal transfer sheets are used without unused areas being left when images are formed on both surfaces of an image-receiving material. Therefore, the efficiency of double-side transfer printing conducted by this process is extremely high.

It is to be noted that also in the above case of using the first thermal transfer printing sheet and the second thermal transfer printing sheet in combination, the reversing unit 86 shown in FIGS. 10 and 11 can be used to reverse the image-receiving material. That is, after the upper front surface (first surface) of the image-receiving material is subjected to transfer printing of a first kind of layer (such as a sublimation dye layer) on the first thermal transfer printing sheet, the image-receiving material is conveyed by the roll conveyor 82 into the rotary holder 89 of the reversing unit 86 and reversed so that the upper front surface is caused to face downward while the lower back surface (second surface) of the image-receiving material is caused to face upward. Thereafter, the reversed image-receiving material is conveyed back to the origin al position, and the back surface of the image-receiving material is subjected to transfer printing of a second kind of layer (such as hot-melt ink layer or a protective laminate layer) on the second thermal transfer printing sheet.

As described above in detail, a thermal transfer printing sheet of the present invention comprises an area for surface transfer printing containing at least a sublimable dye layer composed of sections of one or more colors, and an area for reverse transfer printing containing at least a hot-melt ink layer composed of sections of one or more colors, the two areas being alternately provided on one surface of a substrate sheet. According to the process of double-side transfer printing of the present invention, using the thermal transfer printing sheet of the invention, an image is formed on the surface of an image-receiving material by using the area for surface transfer printing of the thermal transfer printing sheet, and another image is formed on the back of the image-receiving material by using the area for reverse transfer printing. Therefore, images can be formed on both surfaces of an image-receiving material without leaving unused areas on the thermal transfer printing sheet. The efficiency of double-side transfer printing is thus remarkably increased, and the running cost can be considerably decreased.

Further, by the combination use of a first thermal transfer printing sheet containing a hot-melt ink layer whose area is made twice as large as that of a sublimable dye layer so that it can be used to form images on both surfaces of an image-receiving material, and a second thermal transfer printing sheet containing a transferable protective laminate, or by the combination use of a first thermal transfer printing sheet useful for forming an image on the surface of an image-receiving material, and a second thermal transfer printing sheet useful for forming an image on the back of the image-receiving material, images can be formed on both surfaces of an image-receiving material by using two different thermal printers without leaving unused areas on the thermal transfer printing sheets. Therefore, the efficiency of double-side transfer printing is drastically increased, and the running cost can thus be decreased.

What is claimed is:

1. A process of double-side transfer printing comprising the steps of:

providing a thermal transfer printing sheet including a substrate sheet with a surface having a first transfer printing area comprising at least a sublimable dye layer composed of sections of one or more colors, and a second transfer printing area comprising at least a hot-melt ink layer, said two areas being alternately provided on said surface;

superposing said thermal transfer printing sheet on an image-receiving material with said surface of the thermal transfer printing sheet facing a first surface of the image-receiving sheet;

applying heat and pressure from the side of the thermal transfer printing sheet to said first surface of the image-receiving material to conduct transfer printing of one of said sublimable dye layer and said hot-melt ink layer, using one of said first and second transfer printing areas, onto said first surface of the image-receiving material;

holding the image-receiving material, which has been subjected to said transfer printing onto said first surface, in a rotary holder;

rotating the rotary holder and hence the image-receiving material about a rotary axis to reverse the image-receiving material to cause an opposite second surface of the image-receiving material to take the position in which the first surface of the image-receiving material was located, and applying heat and pressure from the side of the thermal transfer printing sheet to said second surface of the image-receiving material to conduct transfer printing of the other of said sublimable dye layer and said hot-melt ink layer, using said second transfer printing area, onto said second surface of the image-receiving material.

2. The process of double-side transfer printing according to claim 1, wherein:

said step of holding the image-receiving material includes:

a step of conveying the image-receiving material along a conveying path after said step of applying heat and pressure to said first surface of the image-receiving material;

a step of maintaining said rotary holder in line with said conveying path; and a step of inserting the image-receiving material slidingly into the rotary holder while the image-receiving material is being conveyed along said conveying path.

3. The process of double-side transfer printing according to claim 2, wherein:

said step of inserting the image-receiving material into the rotary holder includes inserting the image-receiving material into guide grooves provided in the rotary holder.

4. The process of double-side transfer printing according to claim 2, further comprising the step of:

conveying the image-receiving material out of the rotary holder, after said step of rotating the rotary holder, along said conveying path back to a location where said step of applying heat and pressure to said first surface of the image receiving material was carried out.

5. The process of double-side transfer printing according to claim 1, wherein:

said step of rotating the rotary holder includes:

rotating the rotary holder through an angle of 180° until the rotary holder is in line with said conveying path.

6. A process of double-side transfer printing comprising the steps of:

providing a first thermal transfer printing sheet including a substrate sheet with a surface having a first transfer printing area comprising a first kind of transfer layer;

providing a second thermal transfer printing sheet including a substrate with a surface "having a second transfer printing area comprising a second kind of transfer layer which is different from said first kind of tansfer layer";

superposing said first thermal transfer printing sheet on an image-receiving material with said surface of the first thermal transfer printing sheet facing a first surface of the image-receiving material;

applying heat and pressure from the side of the first thermal transfer printing sheet to said first surface of the image-receiving material to conduct transfer printing of said first kind of transfer layer onto said first surface of the image-receiving material;

holding the image-receiving material, which has been subjected to said transfer printing onto said first surface, in a rotary holder;

rotating the rotary holder and hence the image-receiving material about a rotary axis to reverse the image-receiving material to cause an opposite second surface of the image-receiving material to take the position in which the first surface of the image-receiving material was located;

superposing said second thermal transfer printing sheet on the reversed image-receiving material with said surface of the second thermal transfer printing sheet facing the second surface of the image-receiving material; and applying heat and pressure from the side of the second thermal transfer printing sheet to said second surface of the image-receiving material to conduct transfer printing of said second kind of transfer layer onto said second surface of the image-receiving material.

7. The process of double-side transfer printing according to claim 6, wherein:

said step of holding the image-receiving material includes:

a step of conveying the image-receiving material along a conveying path after said step of applying heat and pressure to said first surface of the image-receiving material;

a s tep of maintaining said rotary holder in line with said conveying path; and a step of inserting the image-receiving material slidingly into the rotary holder while the image-receiving material is being conveyed along said conveying path.

8. The process of double-side transfer printing according to claim 7, wherein:

said step of inserting the image-receiving material into the rotary holder includes inserting the image-receiving material into guide grooves provided in the rotary holder.

9. The process of double-side transfer printing according to claim 7, further comprising the step of conveying the image-receiving material out of the rotary holder, after said step of rotating the rotary holder, along said conveying path back to a location where said step of applying heat and pressure to said first surface of the image-receiving material was carried out.

10. The process of double-side transfer printing according to claim 6, wherein:

said step of rotating the rotary holder includes:

rotating the rotary holder through an angle of 180° until the rotary holder is in line with said conveying path.

* * * * *